United States Patent [19]

Scouten et al.

[11] 4,099,968

[45] Jul. 11, 1978

[54] DICARBOXYLIC ACID BIS-AMIDES IN ELECTROSTATIC IMAGING COMPOSITIONS AND PROCESSES

[75] Inventors: Charles G. Scouten, Webster, N.Y.; Willard C. Hamilton, Morganville, N.J.

[73] Assignee: Xerox Corporation, Stamford, Conn.

[21] Appl. No.: 692,255

[22] Filed: Jun. 3, 1976

[51] Int. Cl.[2] ..... G03G 9/00; G03G 13/08

[52] U.S. Cl. ..... 96/1 SD; 252/62.1 R; 252/62.1 P

[58] Field of Search ..... 96/1 SD; 252/62.1; 427/14

[56] References Cited

U.S. PATENT DOCUMENTS

| | | | |
|---|---|---|---|
| 3,501,294 | 3/1970 | Joseph | 96/1.4 |
| 3,674,736 | 7/1972 | Lerman et al. | 252/62.1 |
| 3,951,835 | 4/1976 | Tomono et al. | 96/1 SD |

FOREIGN PATENT DOCUMENTS

| | | | |
|---|---|---|---|
| 2,443,019 | 10/1973 | Fed. Rep. of Germany | 252/62.1 |

*Primary Examiner*—Roland E. Martin, Jr.
*Assistant Examiner*—John L. Goodrow

[57] ABSTRACT

An image developing material comprising particles, said particles including finely divided toner material and a minor proportion based on the weight of said toner material of dicarboxylic acid bis-amides.

8 Claims, No Drawings

DICARBOXYLIC ACID BIS-AMIDES IN ELECTROSTATIC IMAGING COMPOSITIONS AND PROCESSES

This invention relates in general to developing material and more particularly, to improved imaging materials, their manufacture and use.

The formation and development of latent images on the surface of photoconductive materials is well known. The basic process as taught by C. F. Carlson in U.S. Pat. No. 2,297,691, involves placing a uniform electrostatic charge on a photoconductive insulating layer, exposing the layer to a light and shadow image to dissipate the charge on the areas of the layer exposed to the light and developing the resulting latent electrostatic image by depositing on the image a finely divided electroscopic material referred to in the art as "toner". The toner will normally be attracted to those areas of the layer which retain a charge, thereby forming a toner image corresponding to the latent electroscopic image. This powder image may then be transferred to a support surface such as paper. The transferred image may subsequently be permanently affixed to the support surface by heat. Other suitable fixing means such as solvent or overcoating treatment may be substituted for the foregoing heat fixing step.

Many methods are known for applying the electroscopic particles to the latent electrostatic image to be developed. One development method as disclosed by E. N. Wise in U.S. Pat. No. 2,618,552 is known as "cascade" development. In this method, developer material comprising relatively large carrier particles bearing finely divided toner particles is conveyed to and rolled or cascaded across the latent electrostatic image bearing surface. The composition of the toner particles is so chosen as to have a triboelectric polarity opposite that of the carrier particles. In order to develop a negatively charged latent electrostatic image, an electroscopic powder and carrier combination should be selected in which the powder is triboelectrically positive in relation to the carrier. Conversely, to develop a positively charged latent electrostatic image, the electroscopic powder is triboelectrically negative in relation to the carrier. This triboelectric relationship between the powder and carrier depends on their relative positions in a triboelectric series where the materials are arranged in such a way that each material is charged with a positive electrical charge when contacted with any material below it in the series and with a negative electrical charge when contacted with any material above it in the series. As the mixture cascades or rolls across the image bearing surface, the toner particles are electrostatically deposited and secured to the charged portions of the latent image and are not deposited on the uncharged or background portions of the image. Most of the toner particles accidentally deposited in the background are removed by the rolling carrier apparently due to the greater electrostatic attraction between the toner and the carrier than between the toner and the discharged background. The carrier particles and unused toner particles are then recycled. This technique is extremely effective for development of line copy images.

Another technique for developing electrostatic images is the "magnetic brush" process as disclosed, for example, in U.S. Pat. No. 2,874,063. In this method, a developer material containing toner and magnetic carrier particles is carried by a magnet. The magnetic field of the magnet causes alignment of the magnetic carriers in a brush-like configuration. This "magnetic brush" is engaged with an electrostatic image bearing surface and the toner particles are drawn from the brush to the electrostatic image by electrostatic attraction. Many other methods such as "touchdown" development, as disclosed by C. R. Mayo in U.S. Pat. No. 2,895,847, are known for applying toner particles to latent images to be developed. The development processes, as mentioned above, together with numerous variations, are well known to the art through various patents and publications and through the widespread availability and utilization of imaging equipment.

In automatic copying equipment, it is conventional to employ a plate in the form of an endless imaging surface, which is continuously rotated through a cycle of sequential operations including charging, exposing, developing, transfer and cleaning. The plate is usually charged by means of a corona generating device of the type disclosed by L. E. Walkup in U.S. Pat. No. 2,777,957, which is connected to a suitable source of high potential. After forming a powder image on the electrostatic latent image during the development step, the powder image is electrostatically transferred to a support surface by means of a corona generating device, such as the corona device mentioned above, In automatic equipment employing a rotating drum, a receiving surface, to which a powder image is to be transferred, is moved through the equipment at the same rate as the periphery of the drum and contacts the drum at the transfer position interposed between the drum surface and the corona generating device. Transfer is effected by a corona generating device which imparts an electrostatic charge to attract the powder image from the drum to the support surface. The polarity of charge required to effect image transfer is dependent upon the visual form of the original copy relative to the reproduction and the electroscopic characteristics of the developing material employed to effect development. For example, where a positive reproduction is to be made on the positive original, it is conventional to employ a positive polarity corona to effect transfer of a negatively charged toner image to a receiving surface. When a positive reproduction from a negative original is desired, it is conventional to employ a positive charge developing material which is repelled by the charged areas on the plate and deposits on the discharged areas to form a positive image which may be transferred by negative polarity corona. In either case, a residual powder image usually remains on the plate after transfer. Before the plate may be reused for a subsequent cycle, it is necessary that the residual image be removed to prevent unwanted residual images from forming on subsequent copies and to prevent residual film buildup on the photoreceptor. In the positive to positive reproduction process described above, the residual developer powder is tightly retained on the plate surface by a phenomenon that is not fully understood but believed to be caused in part by an electrical charge that prevents complete transfer of the powder to the receiving surface, particularly in the image area. This charge is substantially neutralized by means of a corona generating device prior to contact of the residual powder image with a cleaning device. The neutralization of the charge enhances the cleaning efficiency of the cleaning device.

Various electrostatographic plate cleaning devices such as "brush", "web", and "blade" cleaning apparatus are known in the prior art. A typical brush cleaning apparatus is disclosed by L. E. Walkup et al in U.S. Pat.

No. 2,832,977. Brush type cleaning means usually comprise one or more rotating brushes, which brush residual powder from the plate into a stream of air which is exhausted through a filtering system. A typical web cleaning device is disclosed by W. P. Graff, Jr., et al in U.S. Pat. No. 3,186,838. As disclosed by Graff, Jr. et al, removal of the residual powder from the plate is effected by passing a web of fibrous material over the plate surface.

The sensitivity of the imaging member to abrasion, however, requires that special precautions be exercised during the cleaning phase of the copying cycle. For example, pressure contact between cleaning members and imaging surfaces must be kept to a minimum to prevent rapid destruction of the imaging surface. Although thick protective coatings would protect the imaging surfaces for longer periods of time, the electrical properties of the imaging member impose certain limitations as to the acceptable maximum thickness of the coating. Since thick protective coatings are normally applied by conventional coating techniques, including the use of a film-forming material suspended in a solvent, considerable invonvenience, expense and time is involved in removing the photoreceptor from the machine, preparing the eroded photoreceptor surface for reception of a new coating, applying the new coating, allowing the new coating to dry and reinstalling the newly coated photoreceptor into the machine. Certain extremely thin films, applied to the imaging surface as a pretreatment or in situ during the machine sequence, have been successful, however, the art is constantly searching for improved films or at least practical alternatives. Further, for reasons which are not entirely clear, toner particles are frequently difficult to remove from some photoreceptor coating materials, and toner accumulation causes deterioration of subsequent images formed on the photoreceptor surface in reusable imaging systems. Thus, there is a continuing need for a better system for protecting imaging surfaces, developing electrostatic latent images and removing residual developed images.

It is therefore an object of this invention to provide a system, employing any of the foregoing development techniques, which overcomes the above-noted deficiencies.

It is another object of this invention to provide a developing composition which facilitates transfer of toner particles from an imaging surface to a receiving surface.

It is a further object of this invention to provide a developing composition which promotes removal of toner particles from imaging surfaces by cleaning devices.

It is a still further object of this invention to provide a developing composition which reduces mechanical abrasion of imaging surfaces and cleaning members.

It is another object of this invention to provide a developing composition which promotes the formation of dense transferred toner images.

It is a further object of this invention to provide a developing composition which enhances the stability of imaging surfaces.

It is still a further object of this invention to provide a treatment system which provides imaging surfaces having physical and chemical properties superior to those of known imaging surfaces.

It is yet a further object to provide a system employing a developing process utilizing a novel developing composition.

The above objects and other are accomplished generally speaking, by providing a system employing a reusable imaging surface having maintained thereon a thin film or deposit of a material comprising dicarboxylic acid bisamides.

It is not understood why maintaining a thin film of the defined compound on an imaging surface in a repetitive system effectively protects the imaging surface, facilitates image development, developed image transfer, removal of residual toner and minimization of toner filming or buildup on the imaging surface.

The selected compound can be applied to and maintained on the imaging surface by a variety of techniques. It can be dry dusted onto the surface by a powder puff, dry aerosol, brush, etc., and as with all techniques discussed herein, reapplied intermittently or continuously to maintain an effective layer on the imaging surface. It also can be applied as a film to the imaging surface via a solution or dispersion of the same in a fugutive vehicle or solvent.

A particularly preferred technique of this invention in applying the compound to the imaging surface is by incorporating the compound, as an additive, in a developer composition. Such a compositiom comprises particles including finely divided toner material and a minor porportion based on the weight of the toner, of at least one finely divided compound of the group defined above.

The additive material must be in a form so as to be available to film or coat the imaging surface. By the terms "film or coat" is meant either a continuous or discontinuous layer of the additive on the imaging surface. This layer must be present to an extent sufficient to lubricate the imaging surface or to provide a surface having a free surface energy significantly less than that of the imaging surface per se.

The additive may be mixed with toner in any fashion but is best applied in a form discrete or distinct from the toner material, for example, as individual powder grains or platelets.

In one manner, the objects of this invention are accomplished through a cyclic imaging and development process comprising forming a latent image on an imaging surface; developing said latent image by bringing a developing mixture within the influence of said latent image, said developing mixture comprising particles, said particles including finely divided toner material and at least one compound of the following structure:

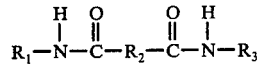

where $R_1$ and $R_3$ may be H, phenyl, lower alkyl substituted phenyl, or lower alkyl groups, where lower alkyl includes groups having from 1 to about 7 carbon atoms in a branched, unbranched, or cyclic configuration, and where $R_2$ may be an alkylene group of 2 to about 22 carbon atoms, phenylene, naphthylene, and phenylene and naphthylene groups bearing lower alkyl substituents of 1 to about 7 carbon atoms in either straight, branched, or cyclic chain configurations.

Among the materials in this invention particularly is adipamide

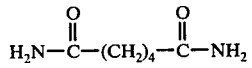

and terephthalamide

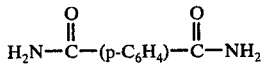

These materials are easily produced using standard laboratory procedures and are commercially available from Aldrich Chemical Company. Inc., of Milwaukee, Wisconsin under their generic chemical names.

The amides of this invention are well known and many are available in commercial quantities being staple articles of commerce. Because of their chemical properties, often the commercially available form is a mixture of related amides and reaction products having a preponderence of the named or identified amide contained therein. Many such commercial products have been found to work satisfactorily in the practice of this invention.

When the developer composition of the present invention is employed for general copying purposes, there may ultimately build up an excessive thickness of the additive on the imaging surface. This buildup can interfere with effective imaging and development. Experience has shown that the average film thickness should not be permitted to exceed about 200 A to 300 A. Any effective means can be employed to maintain the buildup within the limits indicated. Whatever means is employed, it must not be so effective as to completely remove the additive film or coating. As an approximate lower limit, the means must permit a coating or film having an average thickness of at least about 1 A to remain on the imaging surface. As examples of means effective for this purpose, a cleaning member, e.g., a rotating brush, a web or a wiper blade, may be employed with sufficient force and friction to prevent excessive buildup; or the technique of employing a mildly abrasive additive in conjunction with the additive of this invention, as taught in copending application Ser. No. 188,570, filed Oct. 12, 1971, in the names of Don B. Jugle et al may be employed. The particle size of the additive in general is not critical. Broadly stated, in a preferred embodiment where the additive is discrete from the toner particles, a particle size range of 0.5 to 20 microns is preferred.

Concerning the broad relative proportions of the toner material versus the additive of the present invention, functionally stated, the additive should be present in a proportion at least sufficient to form an adherent deposit substantially uniformly distributed over at least 20 percent of the area of an imaging surface during cyclic use of the imaging surface. It is preferred that approximately 100 percent of the imaging area becomes coated with the additive material. It has been found that from about 0.01 to about 10 percent, by weight, of the additive based on the weight of the toner material will achieve the foregoing degree of coverage. A particularly preferred ratio is from about 0.1 percent to about 4.0 percent, by weight, based on the weight of toner.

The toner material of the present invention may be any polymeric toner material which preferably is pigmented or dyed. Typical toner materials include the following resin materials: polystryene, polyacrylic, polyethylene, polyvinyl chloride, polyacrylamide, methacrylate, polyethylene terephthalate, polyamide, and copolymers, polyblends and mixtures thereof. In addition, the following are contemplated: gum copal, gum sandarac, rosin, rosin-modified phenol formaldehyde resins, epoxy resins. Vinyl resins having a melting point or range starting at least about 100° F are especially suitable for use in the toner of this invention. These vinyl resins may be a homopolymer or a copolymer of two or more vinyl monomers. Typical monomeric units which may be employed to form vinyl polymers include: styrene, vinyl naphthalene; mono-olefins, such as ethylene, propylene, butylene, isobutylene and the like; vinyl esters, such as vinyl acetate, vinyl propionate, vinyl benzoate, vinyl butyrate and the like; esters of alphamethylene aliphatic monocarboxylic acids such as methyl acrylate, ethyl acrylate, n-butyl acrylate, isobutyl acrylate, dodecyl acrylate, n-octyl acrylate, methyl methacrylate, ethyl methacrylate, butyl methacrylate, and the like; vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; polyester toner materials of the type disclosed in U.S. Pat. No. 3,590,000; and mixtures thereof.

Suitable materials employed as the toner will usually have an average molecular weight between about 2,000 to about 500,000 and higher.

Any suitable pigment or dye may be employed as the colorant if needed or desired. Examples include carbon black, nigrosine dye, aniline blue, Calco Oil Blue, Chrome yellow, ultramarine blue, duPont Oil Red, quinolien yellow, methylene blue chloride, phthalocyanine blue, Malachite Green Oxalate, lamp black, Rose Bengal and mixtures thereof. The pigment or dyes should be present in the toner in a sufficient quantity to render it highly colored so that it will form a clearly visible image on a recording member. Thus, for example, where conventional copies of typed documents are desired, the toner may comprise a black pigment, such as carbon black. Preferably, the pigment is employed in an amount of from about 1 percent to about 30 percent, by weight, based on the total weight of the colored toner. If the toner colorant employed is a dye, substantially smaller quantities of the colorant may be used.

When the toner materials of the present invention are to be employed in any of the aforementioned development processes, the toner should preferably have an average particle size by weight percent of less than about 30 microns.

As indicated above, the compositions of the present invention find utility in all known xerographic development systems. This includes systems which employ a carrier material, such as magnetic brush development and cascade development, as well as systems which do not necessarily employ a carrier material, such as powder cloud, fiber brush, touchdown development and others.

Suitable coated and uncoated carrier materials for cascade development are well known in the art. The carrier particles comprise any suitable solid material, provided that the carrier particles acquire a charge having an opposite polarity to that of the toner particles when brought in contact with the toner particles so that the toner particles cling to and surround the carrier particles. When a positive reproduction of the electrostatic images is desired, the carrier particles are selected so that the toner particles acquire a charge having a polarity opposite to that of the electrostatic image. Alternatively, if a reversal reproduction of the electrostatic image is desired, the carrier is selected so that the toner particles acquire a charge having the same polarity as that of the electrostatic image. Thus, the materials for the carrier particles are selected in accordance with its triboelectric properties in respect to the electroscopic toner so that when mixed or brought into mutual contact, one component is below the first component in a triboelectric series and negatively if the other component is above the first component in a triboelectric series. By proper selection of materials in accordance with their triboelectric effects, the polarities of their charge, when mixed, are such that the electroscopic toner particles adhere to and are coated on the surface of carrier particles and also adhere to that portion of the electrostatic image bearing surface having a greater attraction for the toner than the carrier particles. Typical carriers include: steel, flintshot, aluminum potassium chloride, Rochelle salt, nickel, potassium chlorate, granular zircon, granular silica, ferrites, methyl methacrylate, glass, and the like. The carriers may be employed with or without a coating. Many of the foregoing and other typical carriers are described in U.S. Pat. No. 2,618,552. An ultimate coated particle diameter between about 50 microns to about 2,000 microns is preferred because the carrier particles then possess sufficient density and inertia to avoid adherence to the electrostatic images during the cascade development process. Adherence of carrier beads to electrostatic drums is undesirable because of the formation of deep scratches on the surface during the image transfer and drum cleaning steps. Also, print deletion occurs when large carrier beads adhere to xerographic imaging surfaces. For magnetic brush development, carrier particles having an average particle size less than about 800 microns are satisfactory. Generally speaking, satisfactory results are obtained when about 1 part toner is used with about 10 to about 1,000 parts by weight of carrier in the cascade and magnetic brush developers.

The developer compositions of the instant invention may be employed to develop electrostatic latent images on any suitable imaging surface including conventional photoconductive and non-photoconductive surfaces. Well known photoconductive materials include vitreous selenium, zinc oxide, organic or inorganic photoconductors embedded in a non-photoconductive matrix or inorganic or organic photoconductors embedded in a photoconductive matrix or homogeneous organic photoconductor, typified by PVK/TNF photoconductors or the like. Representative patents which disclose contemplated photoconductive materials include U.S. Pats. No. 2,803,542; 2,970,906; 3,121,006; 3,121,007; 3,151,982 and 3,484,237.

In the process of the present invention, conventional means may be employed to clean or remove residual toner from the imaging surface after developed image transfer to a receiving surface. These means include any type of fiber brush, woven or non-woven web, resilient porous material, blades and the like. A particularly preferred cleaning means is one or more doctor blades placed either in a chiseling or wiping attitude and the blade may or may not translate laterally across the imaging surface during cleaning. The pressure of the cleaning means may be adjusted not only to most effectively remove residual toner but also to prevent the additive material from deleteriously building up on the imaging surface. Typical blade materials include inflexible and flexible organic or inorganic materials, such as aluminum, copper, polyurethanes, Teflon, polypropylene, natural rubber, polysiloxane rubber, cork, etc.

Satisfactory results have been obtained in one system employing a single synthetic rubber blade, operating in a chiseling attitude with a blade pressure of about 0.06 pounds per linear inch against an endless photoreceptor surface having a speed of about 6.6 inches per second.

The following examples are not limitative to the invention but further define, describe and compare exemplary developing compositions and the use thereof in a developing and cleaning process. Parts and percentages are by weight unless otherwise indicated.

EXAMPLE I (STANDARD FOR COMPARISON)

The vitreous selenium photoconductor drum of an automatic copying machine is corona charged to a positive voltage of about 800 volts and exposed to a light and shadow image to form an electrostatic latent image. The drum is then rotated through a magnetic brush development station. The control developer used in this process comprises 2 parts toner, which contains a commercially available styrene-n-butyl methacrylate copolymer, colored with carbon black, and about 100 parts of commercially available steel shot carrier beads. These toner particles have an average particle size of about 12 microns and the carrier beads an average particle size of about 125 microns.

After the latent image is developed, the resulting toner image is transferred to a sheet of paper at the transfer station and the imaging surface is cleaned by means of a synthetic rubber doctor blade held at a chiseling attitude to the photoreceptor.

Initial copies reveal good copy quality in all respects, however, after about 500 copies, image quality is markedly inferior showing high background density, poor image fill and decreased resolution. Inspection of the drum reveals a significant toner residue buildup on the imaging surface.

EXAMPLE II

The procedure of Example I is repeated execpt the developer is modified by the addition of adipamide having an average particle size distribution of from 0.5 to 10 microns. The modification is effected by mechanically uniformly mixing 0.25 percent, by weight, stearamide based on the weight of the toner, with the toner. Thereafter, the toner and additive is mxed with the carrier.

After 50,000 cycles, copy quality remained good in comparison with Example I and no deleterious toner residue build-up was seen on the photoreceptor.

EXAMPLE III

The process of Example I is repeated except the developer is modified in the same manner of Example II by the addition of 2.0 percent terephthalamide having an average particle size distribution of from 0.5 to 10 microns.

After 5,000 cycles, copy quality is better than Example I with far less toner residue build-up on the photoreceptor.

EXAMPLE IV

The process of Example I is repeated except the developer is modified in the same manner of Example II by the addition of 3.0 percent adipamide, having an average particle size distribution of from 0.5 to 10 microns. After 5,000 cycles, copy quality is noticeably better than Example I with far less toner residue present.

Although specific materials and conditions are set forth in the foregoing examples, these are merely intended as illustrations of the present invention. Various other suitable components, additives, colorants, carriers and development techniques, such as those referred to above, may be substituted in the Examples with similar results.

Other modifications of the present invention will occur to those skilled in the art upon a reading of the present invention. These are intended to be included within the scope of this invention.

What is claimed is:

1. An image developing material comprising particles, said particles including finely divided toner material and an active amount, based on the weight of said toner material, of a separate additive of the formula

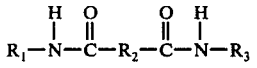

wherein $R_1$ and $R_3$ are individually defined as a H, phenyl, lower alkyl-substituted phenyl, or lower alkyl group, where lower alkyl contains from 1 to about 7 carbon atoms in a branched, unbranched, or cyclic configuration; and $R_2$ is defined as an alkylene group of 2 to about 22 carbon atoms, phenylene, naphthylene, lower alkyl-substituted phenylene, or lower alkyl-substituted naphthylene group in which lower alkyl substituents contain 1 to about 7 carbon atoms in straight, branched, or cyclic chain configuration.

2. The developing material of claim 1 wherein the additive is adipamide.

3. The developing material of claim 1 wherein the additive is terephthalamide.

4. The developing material of claim 1 wherein said developing material comprises from about 0.01 percent to about 10 percent by weight of said additive based on the weight of said toner.

5. The developing material of claim 1 wherein said developing material comprises from about 0.1 percent to about 4 percent by weight of said additive based on the weight of said toner.

6. The developing material of claim 1 including from 10 to 1,000 parts by weight of carrier particles per part of toner, said carrier particles being larger than said finely divided toner material.

7. An imaging process comprising the steps of:

(a) forming an electrostatic latent image on an imaging surface;

(b) developing said latent image by bringing an electrostatographic developing mixture within the influence of said latent image, said developing mixture comprising particles, said particles including (1) finely divided electroscopic toner material and (2) an active amount, based on the weight of said toner material, of a separate additive of the formula

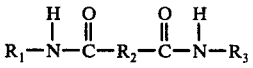

wherein $R_1$ and $R_3$ are individually defined as a H, phenyl, lower alkyl-substituted phenyl, or lower alkyl group, where lower alkyl contains from 1 to about 7 carbon atoms in a branched, unbranched, or cyclic configuration; and $R_2$ is defined as an alkylene group of 2 to about 22 carbon atoms, phenylene, naphthylene, lower alkyl-substituted phenylene or lower alkyl-substituted naphthylene groups in which lower alkyl substituents contain 1 to about 7 carbon atoms in straight, branched, or cyclic chain configurations;

(c) removing at least a portion of at least any residual developed image from said imaging surface; and (d) repeating the process in sequence at least one additional time.

8. The imaging process of claim 7 wherein said particles include carrier particles which are larger than said finely divided toner material.

* * * * *